US011415027B1

(12) United States Patent
Ganley

(10) Patent No.: US 11,415,027 B1
(45) Date of Patent: Aug. 16, 2022

(54) MULTIPORT ROTARY VALVE FOR PISTON ENGINES

(71) Applicant: James T Ganley, St. Paul, MO (US)

(72) Inventor: James T Ganley, St. Paul, MO (US)

(73) Assignee: James T. Ganley, St. Paul, MO (US)

( * ) Notice: Subject to any disclaimer, the term of this patent is extended or adjusted under 35 U.S.C. 154(b) by 6 days.

(21) Appl. No.: 17/232,885

(22) Filed: Apr. 16, 2021

(51) Int. Cl.
*F01L 7/16* (2006.01)
*F01L 7/02* (2006.01)

(52) U.S. Cl.
CPC ..... *F01L 7/16* (2013.01); *F01L 7/026* (2013.01)

(58) Field of Classification Search
CPC ..... F01L 7/16; F01L 7/026
See application file for complete search history.

(56) References Cited

FOREIGN PATENT DOCUMENTS

CN 203309160 U * 11/2013

* cited by examiner

*Primary Examiner* — Jacob M Amick
*Assistant Examiner* — Charles J Brauch

(57) ABSTRACT

A multi-port rotary valve has penetrations in the form of annulus sectors through its stationary outer shell and through its rotating inner core, with the penetrations being situated so that, once during each rotation of the core, each core penetration overlaps and becomes volumetrically linked to a corresponding congruent pair of shell penetrations, thereby creating, in an ordered temporal sequence, high conductance flow passages that extend completely through the valve. The azimuth-angle locations of the penetrations determine the relative times at which the valve's flow passages begin to open. The central angles of the penetrations determine the duration of the time intervals for which the flow passages are open or partially open. The radial extent of the penetrations determines the conductance of the flow passages.

4 Claims, 8 Drawing Sheets

MULTIPORT ROTARY VALVE FOR PISTON ENGINES

BACKGROUND OF THE INVENTION

This invention relates to a multi-port rotary valve which uses a single annular disk to provide precise temporal control of the flow of fuel, oxidant, and exhaust gases in piston engines. The valve offers an improved timing capability for most types of piston engines, and it provides an essential timing capability for piston engines which do not use a concurrent compression process as part of their operating cycles.

All internal combustion piston engines brought into service during the past 150 years have had operating cycles that include a concurrent compression process. Compression of a gaseous oxidant or a gaseous fuel/oxidant mixture prior to combustion provides the capability for large volumetric expansion ratios for the combustion products, and larger expansion ratios are directly associated with more efficient engines. However, the compression process as performed in contemporary piston engines imposes severe design constraints on engine components. In these engines, expansion of combustion products occurs within the same physical volume as compression of the oxidant or the fuel/oxidant mixture. The expansion ratio of the combustion products is thereby constrained to be equal to, or very nearly equal to, the compression ratio of the oxidant or the fuel/oxidant mixture. Higher compression ratios, which produce higher expansion ratios and correspondingly higher engine efficiencies, require heavier, more robust engine components that are made of materials capable of withstanding very high temperatures. Ultimately, these design constraints limit the compression and expansion ratios which can be practicably realized, and this, in turn, limits the achievable efficiency of engines utilizing a concurrent compression process.

U.S. Pat. No. 10,352,233 discloses an external-compression (non-concurrent compression) two-stroke engine offering high efficiency. For the engine revealed therein, compression of fuel and oxidant gases is done non-concurrently with engine operation, by equipment that is not involved with the engine's operating cycle, and usually by equipment that is remote from the engine's operating platform. Operation of the engine requires inputs of high-pressure fuel and oxidant gases that are supplied from external reservoirs, and these gases must be injected into the engine's cylinders immediately after the associated pistons reach their top-dead-center positions. The fuel and oxidant inlet passages must go from the closed position to the open position and then back to the closed position during a crankshaft rotation of only few degrees. Camshaft-driven poppet valves used in conventional piston engines are incapable of this type of rapid response because the required ramp slopes of the cam lobes would be so large that rotation of the camshaft would be blocked by the cam followers.

Another important characteristic of the engine revealed in the above referenced patent is that highest efficiency is achieved when the clearance volume of the engine's cylinders (internal volume of the cylinders at piston top-dead-center) is as close to zero as reasonable mechanical tolerances will allow. This means that, in order to optimize the engine's efficiency, it is necessary to ensure that fuel and oxidant inlet valves and exhaust valves do not mechanically interfere with the movement of the pistons as they approach and recede from their top-dead-center positions. Spring loaded poppet valves and other related valves currently used in piston engines are reentrant with respect to the internal volume of their host engine's cylinders and therefore cannot meet this non-interference requirement.

The primary objective of the present invention is to provide a straightforward method of managing the flow of fuel, oxidant, and exhaust gases in external-compression two-stroke engines, that is, in engines of the type revealed in U.S. Pat. No. 10,352,233. Valves currently used in piston engines are not well suited to performing the demanding flow management tasks required to achieve highest efficiency in engines of that type. The novel valve design revealed in this specification is capable of performing the required flow control tasks, thereby providing enabling technology for an important category of piston engines. In addition, the presently revealed valve design is mechanically compatible with the very small clearance volumes required for optimal performance of the targeted engine type. Furthermore, the utility of the valve revealed in this specification is not limited to applications involving the external-compression engines referenced above. The valve can also provide important timing improvements for most contemporary internal-compression (concurrent compression) piston engines.

BRIEF DESCRIPTION OF THE INVENTION

The valve revealed in this specification has penetrations through its stationary outer shell and through its rotating inner core, with the penetrations being situated so that once during each rotation of the core, each core penetration overlaps and becomes volumetrically linked to a corresponding pair of shell penetrations. This creates, in an ordered temporal sequence, high conductance flow passages that extend completely through the valve. The azimuthal locations of the various shell and core penetrations determine the relative times at which the valve's flow passages begin to open. The azimuthal extent of the penetrations determines the duration of the time intervals for which the flow passages remain open. The radial extent of the penetrations—which can be chosen independently of the azimuthal dimensions of the penetrations—determines the relative conductance of the flow passages.

The preferred embodiment of the present invention involves its use in two-stroke, external-compression piston engines. External-compression engines require extremely accurate temporal management of the internal transfer of fuel, oxidant, and exhaust gases. Valves of the type revealed herein—one valve for each of an engine's cylinders—provide precise control of the relative and absolute times at which fuel and oxidant gases enter the engine's cylinders and exhaust gases exit the cylinders.

Best performance of the external-compression engine referenced above is achieved when (1) each cylinder's fuel and oxidant input passages open and close at specific, predetermined times during the initial phase of the associated piston's power stroke, with the relevant time intervals involving only a few degrees of crankshaft rotation; (2) each cylinder's exhaust passage begins to open precisely at the time of piston bottom-dead-center, just as the piston is beginning its upward stroke; and (3) each cylinder's exhaust passage becomes completely closed precisely at the time of piston top-dead-center, just as the piston has completed its upward stroke. The valve revealed herein offers a straightforward method for efficiently accomplishing these demanding, time-critical tasks. The valve thereby provides enabling technology for an important category of piston engines.

DETAILED DESCRIPTION OF THE INVENTION

Figure 1:
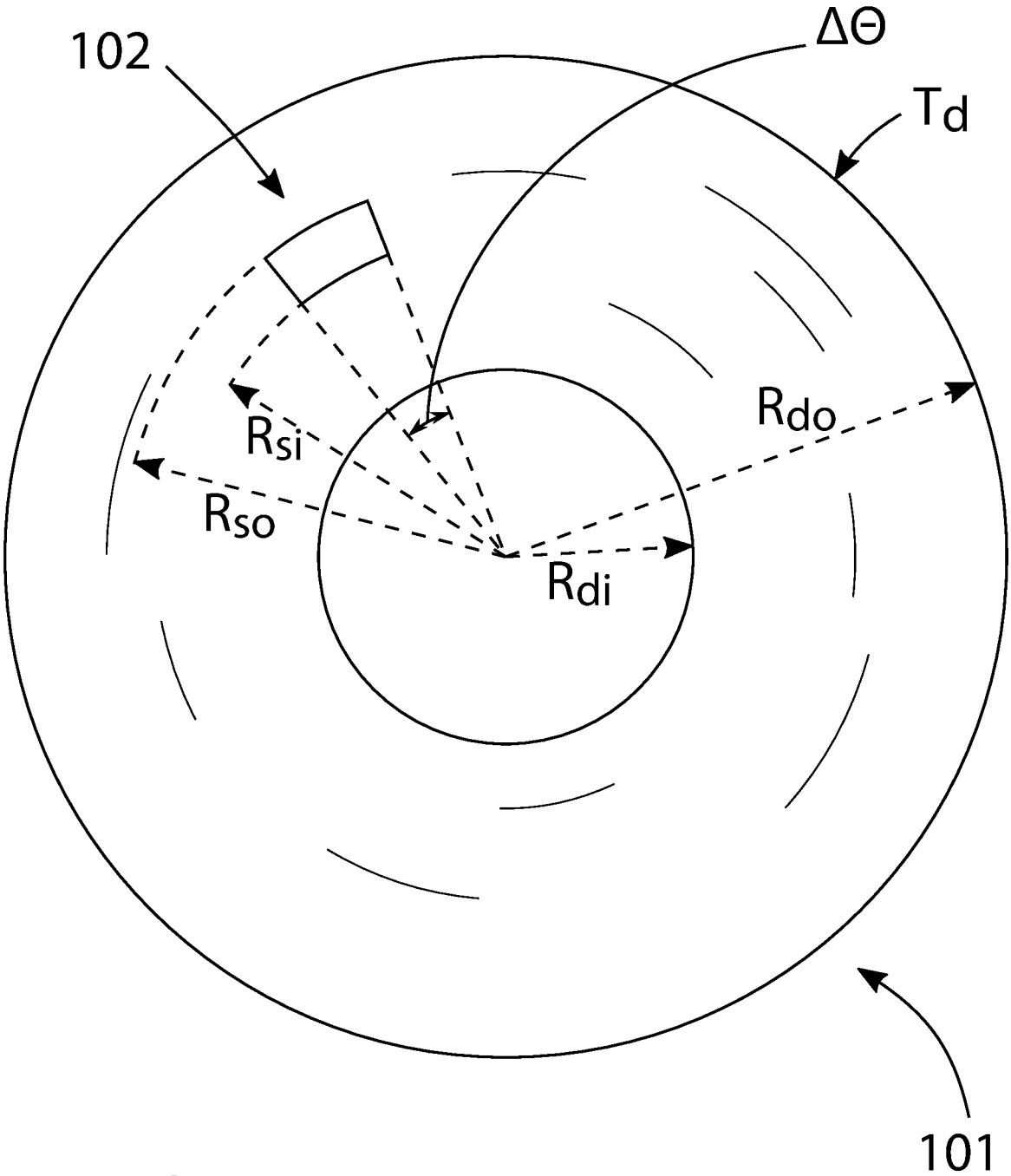
Prior Art FIG. 1
FIG. 1 shows the top view of an annular disk and a small annulus sector which has the same central axis as the larger annular disk.

This specification uses terms which have a technical meaning that may differ from the meaning assumed in everyday usage. The following paragraphs contain definitions and explanations of various terms and concepts with regard to the meaning intended herein.

All internal combustion engines convert the chemical potential energy of fuel and oxidant species into mechanical energy, with the conversion being accomplished through combustion of the fuel and oxidant. The term "piston engine" is used herein to refer to an internal combustion engine in which one or more closed cylinders serve as combustion chambers for fuel and oxidant, with high-pressure combustion products forcing the movement of pistons within the cylinders. For the engines dealt with in this specification, each cylinder contains one moveable piston.

The term "operating cycle" and the term "engine's operating cycle" are used interchangeably herein to refer to a temporally ordered sequence of thermodynamic processes that is executed repetitively within a piston engine and concurrently with engine operation. The thermodynamic processes act on the engine's working fluid (fuel, oxidant, and associated combustion products) in a manner which results in the conversion of chemical energy into mechanical energy. A piston engine's operating cycle is the means by which it converts chemical energy to mechanical energy. (It is generally understood that thermodynamic processes—as related to internal combustion engines—are actions that involve changing the thermodynamic state variables (pressure, temperature, and molar density) of the engine's working fluid by executing thermodynamic work or by transferring thermal energy, with the work being done either on or by the working fluid, and with the transfer of thermal energy being either to or from the working fluid. The thermodynamic processes are executed repetitively within the engine and concurrently with engine operation. If one or more of the processes is terminated, engine operation ceases. The combustion process is a distinguishing process that occurs within internal combustion engines. It is generally considered to be a process which alters the chemical makeup of the engine's working fluid and then transfers thermal energy to the combustion products, with the thermal energy being derived from the chemical energy stored in the chemical reactants.)

The term "two-stroke engine" is used herein to refer to a piston engine wherein the processes constituting the engine's operating cycle are executed sequentially in each of the engine's individual cylinders by the action of a single piston moving within each cylinder, with the piston completing two full strokes per cycle. The term "four-stroke engine" is used herein to refer to a piston engine wherein the processes constituting the engine's operating cycle are executed sequentially in each of the engine's individual cylinders by the action of a single piston moving within each cylinder, with the piston completing four full strokes per cycle. A two stroke engine executes one power stroke for every two piston strokes; a four-stroke engine executes one power stroke for every four piston strokes.

The term "internal-compression engine" is used herein to refer to a piston engine wherein compression of a gaseous oxidant or a gaseous fuel/oxidant mixture occurs within the engine, concurrently with engine operation. The compression may be done by the movement of a piston within a cylinder or by auxiliary equipment (supercharger, turbocharger, supplementary compressor, etc.) acting concurrently with engine operation. Most contemporary piston engines are internal-compression engines.

The term "external-compression engine" is used herein to refer to a piston engine whose operating cycle does not include a compression process. In an external-compression engine, compression of the oxidant or the fuel/oxidant mixture is done before the fuel and oxidant chemicals enter the engine's cylinders. The compression is done non-concurrently with engine operation, usually at locations that are remote from the engine's operating platform. External-compression engines, such as are revealed in U.S. Pat. No. 10,352,233, offer very high efficiency, but they require improved valve technology in order to achieve optimal performance.

In the field of mechanical engineering, the word "assembly" is generally used to refer to a subunit of a complete machine. An assembly is comprised of a set of interconnected subassemblies; a subassembly is an interconnection of a specific set of manufactured parts. In this specification, a piston engine is considered to be a complete machine. The term "valve assembly" is used herein to designate a specific subunit (assembly) of a piston engine. A valve assembly is created by the interconnection of two or more of the presently revealed valves, which are considered to be subassemblies of the valve assembly. As components of the valve assembly, each of the presently revealed valves provides temporal management of the flow of fuel, oxidant, and exhaust gases for one of the parent engine's cylinders. The cylinder for which one of the presently revealed valves provides flow control is referred to herein as the valve's "associated cylinder."

The word "annulus" is defined here as a three-dimensional solid object whose boundaries are defined by two substantially planar surfaces and two concentric cylindrical surfaces, with the common axis of the cylindrical surfaces being perpendicular to the two planar surfaces. The common axis of the two cylindrical surfaces is axis of the annulus. The word "annular is used herein to refer to an object which has the shape of an annulus. The term "annular disk" is used herein to refer to an annular object whose outer radius is considerably greater than the distance between its planar surfaces. The term "annulus sector" is used herein to refer to a portion of an annular disk which is bounded azimuthally by two closed half-planes containing, and extending from, the axis of the annular disk. From this definition, it is seen that the inner and outer radii of an annulus sector are equal in length to the inner and outer radii of the parent annular disk. Also, the axis of an annulus sector coincides with the axis of its parent annular disk.

FIG. 1 shows the top view of annular disk 101, which has inner radius $R_{di}$, outer radius $R_{do}$, and thickness $T_d$. FIG. 1 also shows an annulus sector 102 which is contained within annular disk 101, with annulus sector 102 having inner radius $R_{si}$, outer radius $R_{so}$ and central angle $\Delta\theta$. The term "azimuthal extent" is used herein to refer to the central angle of an annulus sector. It is noted that annular disk 101 is the not the parent of annulus sector 102, even though they both have the same axis. The parent annular disk for annulus sector 102 would have inner and outer radii $R_{si}$ and $R_{so}$, respectively.

The radial location of an annulus sector is defined by its inner and outer radii. In this specification, two annulus sectors having a common central axis are said to have the same radial location if their inner radii are equal to each other and their outer radii are equal to each other. Two annulus sectors having a common central axis are said to have different radial locations if the inner radius of one of the sectors is greater than the outer radius of the other. In this specification, two annulus sectors sharing a common axis have either the same radial location or they have a different radial location, as defined above. The intermediate situation, wherein the inner radius of one of the sectors is greater than the inner radius of the other sector but less than the outer radius of the other sector (partial radial overlap), is not dealt with in this specification. Two annulus sectors are said to have the same azimuthal location relative to a common axis if they are azimuthally bounded by the same two closed half-planes, both of which extend from the common axis of the sectors.

In this specification the term "closely engaged" is used to refer to two surfaces positioned so that a gas-tight seal can be created between them, either as a stationary seal in the form of a gasket, or as a rotating seal in the form of a lubricant. The term "mesh with," the term "meshes with," and the term "meshed with" are used herein to refer to the interface between two sets of gear teeth that are associated with different axes, with the interface being such that torque applied about one of the gear axes is efficiently transferred to the other gear axis. It is noted that not all meshed gears are bidirectional.

The term "flow passage" is used herein to refer to an open ended volume through which fluid may flow when a pressure difference exists between the openings at its ends. The openings at the ends of a flow passage are referred to as "ports."

The word "reservoir" is used herein to refer to a volume of fluid with physically identifiable boundaries. The concept of a reservoir includes such diverse enclosures as a tank of compressed fuel or oxidant gases, the internal volume of an engine's cylinder, or the volume within an engine's exhaust manifold. Flow passages provide a pathway for transferring fluid (gases in this specification) from one reservoir to another.

The word "valve" is used herein to refer to a device which contains one or more flow passages. In general, for any particular valve design, changing the relative positions of some of the valve's components causes a flow passage (or flow passages) within the valve to become more restrictive or less restrictive to fluid flow. In most instances in this specification, the presently revealed valve is referred to simply as "the valve."

The word "hole" is used herein to refer to an opening which passes completely through a solid object. The exception to this definition is that, for an engine block, the term "threaded mounting hole" is used to describe an opening that has a limited depth and does not pass completely through the engine block. Generally, when the word "hole" is used, the cross-sectional shape of the hole is not indicated or defined. However, in this specification, unless otherwise noted, the word "hole" is used to designate an opening with a circular cross section.

The word "penetration" is used herein to refer to a hole which has the cross-sectional shape of an annulus sector. In this specification, flow passages are comprised of volumetrically linked penetrations that pass through specific valve components. Relative motion of these valve components changes the degree of alignment or misalignment of the penetrations, thereby causing the flow passages comprising the penetrations to have an increased or decreased ability to conduct fluid flow.

From these definitions, it is seen that a valve is a dynamic device in that external forces can cause physical movement of valve components, thereby producing variations in the ability of the valve's flow passages to transfer fluid between reservoirs that are connected to ports at their ends. The word "conductance" is used herein to refer to the relative ability of a flow passage to allow or facilitate fluid flow.

A flow passage is said to be "closed" when valve components are disposed so as to present the minimum conductance consistent with the valve's mechanical design. When a flow passage is closed, the fluid flow rate through the flow passage is reduced to a very low value which, for a properly designed valve, is essentially zero. A flow passage is said to be "open" when valve components are disposed so as to present the maximum conductance consistent with the valve's mechanical design. When a flow passage is open, the fluid flow rate through the flow passage has a relatively high value. A flow passage is said to be partially open (or partially closed) when valve components are disposed so as to present a conductance which is intermediate between the fully open and the fully closed values. The time period during which the conductance of a flow passage is changing from closed to open or from open to closed is referred to as a "transition period." When the valve revealed in this specification is functioning, its flow passages are either fully open, fully closed, or in a transition period.

The valve disclosed in this specification provides accurate temporal management of fluid flow between multiple reservoirs. Although the valve could be used in many different applications, including most types of piston engines, the preferred embodiment relates to the specific type of two-stroke external-compression engine revealed in U.S. Pat. No. 10,352,233, wherein the engine's operating cycle does not include a compression process, but instead includes a process that involves injecting high pressure fuel and oxidant gases directly into the engine's cylinders. Engines of the type revealed in the referenced patent require precise relative and absolute control of the time intervals during which fuel, oxidant, and exhaust gases enter and exit the engine's cylinders. By the very nature of its operating cycle, the engine referenced above requires very rapid closed-opened-closed transitions for all of the valves' flow passages. The presently disclosed valve offers the required precision and the required speed in a simple, reliable, efficient device. In addition, the valve's planar mechanical profile is compatible with having a near-zero clearance volume for the cylinders of the targeted engine type, a characteristic which is necessary to achieve optimal engine performance. Spring-loaded poppet valves and other related valves that are currently used in piston engines do not provide the required precision or the required speed, nor do they offer an appropriate mechanical interface.

The preferred embodiment of the presently revealed valve involves its direct attachment to the engine block of a piston engine. For a multi-cylinder engine, one of the presently revealed valves is deployed for each of the host engine's cylinders. Each valve controls the flow of gases into and out of one cylinder, which, as mentioned above, is referred to herein as the valve's "associated cylinder." The engine block containing the valve's associated cylinder is referred to herein as the "associated engine block." When the presently revealed valve is attached to its associated engine block as discussed herein, one of the valve's end walls, referred to as the lower end wall, serves as the stationary end of its associated cylinder, thereby allowing each of the valve's flow passages to communicate directly with the internal volume of the cylinder. At the valve's upper end wall, that is, at the end wall farthest from the associated cylinder, each of the valve's flow passages is connected to a specific gas reservoir. For example, one of the flow passages might be connected to a reservoir containing pressurized gaseous fuel, another might be connected to a reservoir containing pressurized gaseous oxidant, and still another might be connected to an exhaust manifold. The valve's flow passages provide a means for transferring fuel, oxidant, and exhaust gases to and from the valve's associated cylinder.

The valve is comprised principally of three parts: a shell which is fixed in position and orientation relative to surrounding structure, an annular core which is capable of rotation within the shell, and a core driveshaft which transfers torque to the annular core in order to force its rotation within the shell.

The term "valve axis" is used herein to refer to the axis about which the annular core rotates. The valve design is such that, when the valve is attached to its associated engine block, the valve axis coincides with the central axis of the associated cylinder. In the discussions that follow, the valve axis is to be considered the axis (the Z-axis) of a cylindrical coordinate system which is referred to herein as the 'valve coordinate system." In the valve coordinate system, the coordinates of a point, P, are expressed as $P(r, z, \theta)$. The radial coordinate, r, is a distance measured perpendicularly from the valve axis to the point P; the axial coordinate, z, is a distance measured parallel to the valve axis from a reference plane perpendicular to the valve axis to the point P; the azimuthal coordinate, $\theta$, is an angle measured between two lines segments that intersect at, and extend perpendicularly from, the valve axis, with one of the line segments lying in a reference plane that contains the valve axis, and with the other line segment containing the point P.

The valve's shell has the form of a rigid mechanical fixture which encloses an internal cavity. The shell is comprised of (1) a circularly cylindrical annular hub whose curved outer surface defines the inner boundary of the internal cavity, (2) two parallel, substantially planar end walls (a lower end wall and an upper end wall) whose opposed (inner) surfaces define the axial boundaries of the internal cavity, and (3) an outer wall whose inner surface defines the outer boundary of the internal cavity. For ease of manufacture, the shell is fabricated as two separate pieces. One of the pieces, referred to herein as the "core housing," comprises the lower end wall, the side wall, and the annular hub. The other piece of the shell is its upper end wall, which is sometimes referred to herein as the "core housing cover." The central hole in the shell's annular hub is the hub feedthrough hole. The hub feedthrough hole has tapered threads at its lower end, which is the end nearest the valve's associated cylinder. The tapered threads provide a means for installing a high-voltage electrical feedthrough (spark plug). The shared central axis of the annular hub and the hub feedthrough hole coincides with the valve axis. As mentioned above, the valve's annular core rotates around the valve axis.

Figure 2A:
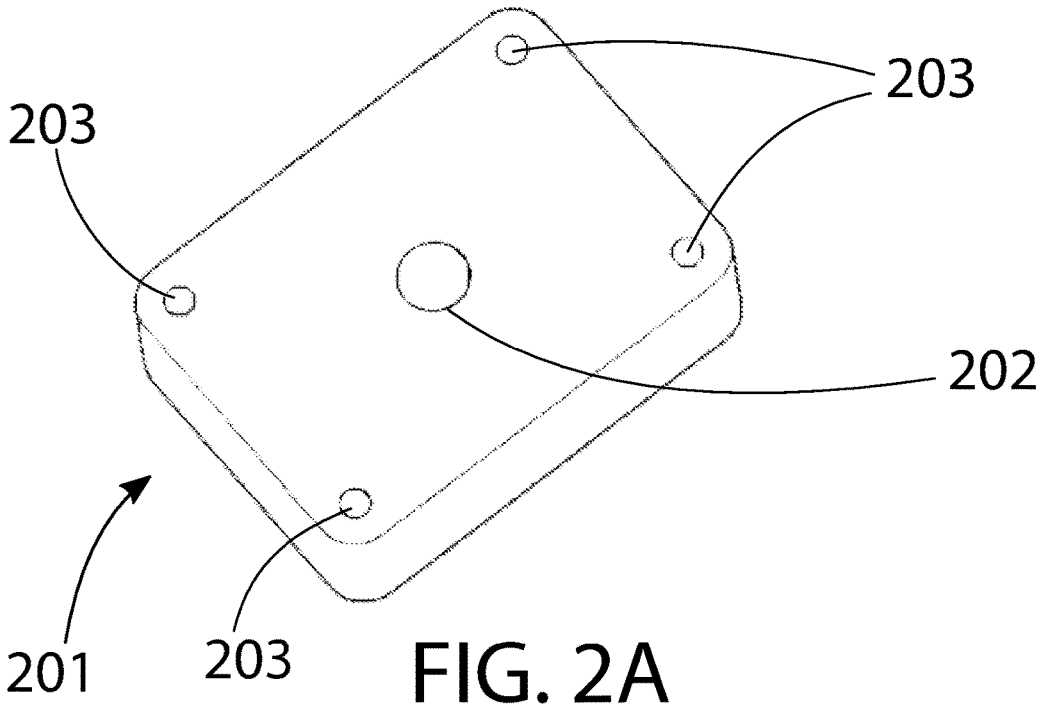
FIG. 2A shows the valve's core housing cover.
Figure 2B:
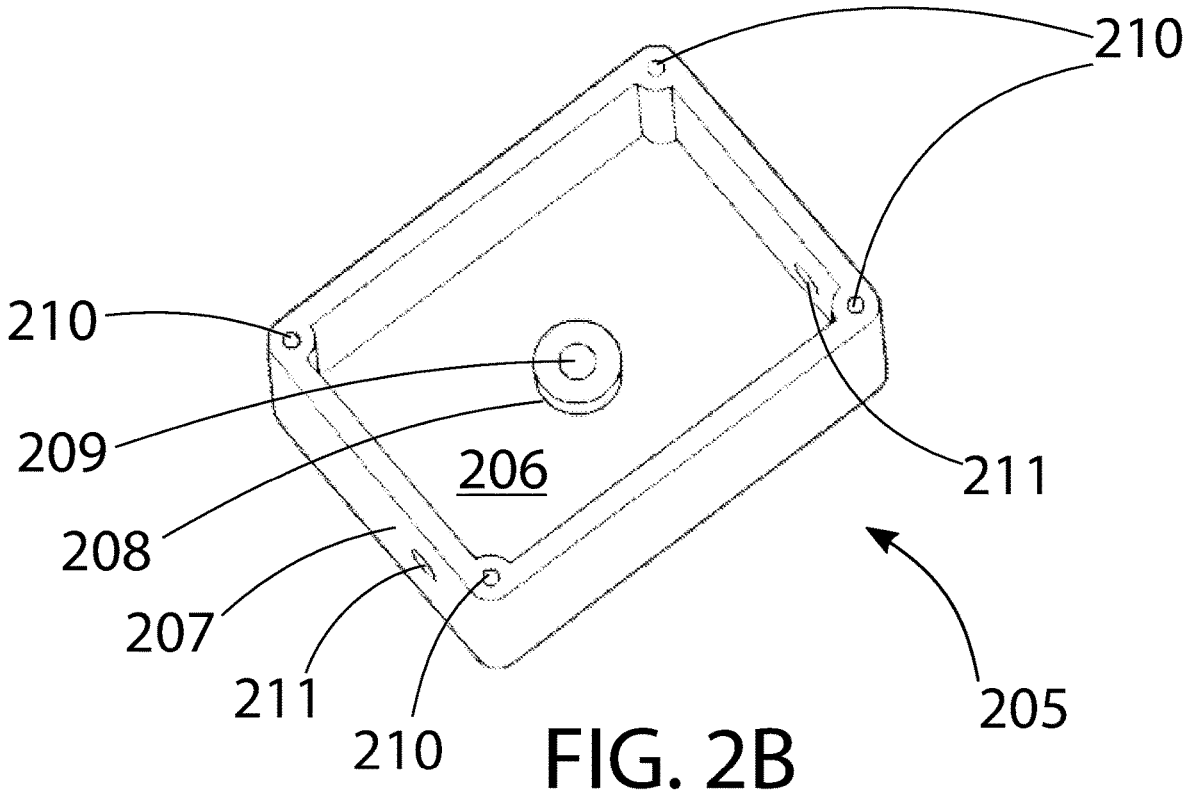
FIG. 2B shows the valve's core housing.

FIG. 2A shows upper end wall (core housing cover) 201, with cover feedthrough hole 202, and cover mounting holes 203 (4 each). FIG. 2B shows core housing 205, with lower end wall 206, side wall 207, annular hub 208, hub feedthrough hole 209, housing mounting holes 210 (4 each), and core driveshaft guide holes 211 (2 each).

During valve assembly, the valve's annular core (not shown in FIG. 2B) is placed inside core housing 205. Then cover mounting holes 203 are aligned with housing mounting holes 210 as core housing cover 201 is placed on core housing 205. The resulting axially linked mounting holes are referred to herein as "through mounting holes." The through mounting holes extend completely through the valve's shell. Threaded bolts may be inserted into the through mounting holes and threaded into corresponding threaded mounting holes in the associated engine block. When an appropriate gasket is placed between the engine block and the valve's lower end wall 206, and an appropriate gasket is placed between the vale's side wall 207 and core housing cover 201, tightening the threaded bolts accomplishes attachment of the valve to the engine block.

When cover mounting holes 203 and housing mounting holes 210 are aligned to form the through mounting holes, cover feedthrough hole 202 and hub feedthrough hole 209 also become aligned. The resulting axially linked holes are referred to as the "electrical feedthrough hole." The electrical feedthrough hole extends completely through the valve shell. A high-voltage electrical feedthrough (spark plug) can be mounted in the electrical feedthrough hole, with the mounting accomplished by means of tapered threads at the bottom (end nearest the associated cylinder) of the hole. When a high-voltage electrical feedthrough is threaded into the tapered threads of the electrical feedthrough hole, a gas tight seal is formed around the feedthrough and its electrodes are mechanically constrained to be at the upper boundary of the associated cylinder's internal volume. This location ensures that the feedthrough electrodes, which extend beyond the main body of the feedthrough, cannot interfere with the movement of the piston. The axis of the electrical feedthrough hole and the axis of the electrical feedthrough mounted in it both coincide with the valve axis. The central radial location of the feedthrough's electrodes means that the combustion flame front progresses symmetrically from the cylinder axis and produces radially symmetric forces on the piston head. (Thermal initiation of the combustion process, which is used in diesel engines, is not possible in the external-compression engine of U.S. Pat. No. 10,352,233 because the engine's operating cycle does not include a compression process. Spark ignition is required.)

The valve's core has the form of an annular disk which fits snugly within the shell's internal cavity, closely engaging the outer curved surface of the shell's annular hub and the inner surfaces of the shell's planar end walls. During engine operation, as the annular core rotates within the shell's internal cavity, the closely engaged shell and core surfaces are continuously suffused with a lubricating sealant which provides a gas-tight seal between the closely engaged surfaces while at the same time allowing the core to rotate freely around the valve's annular hub. The inner surfaces of the shell's end walls and the planar surfaces of the annular core are circularly corrugated so that, when the valve is assembled and the planar surfaces of the shell and core are fitted together, the corrugation peaks of each planar surface closely engage the corrugation valleys of the opposing planar surface. The corrugations provide additional surface area for conducting heat away from the shell's lower end wall, they provide greater integrity to the rotating seals between the closely engaged surfaces, and they provide a large surface area for mitigating the thrust forces generated by the core driveshaft.

The close fit of the annular core around the annular hub causes the annular core and the annular hub to be coaxial and their axes therefore coincide with the valve axis.

Figure 3A:
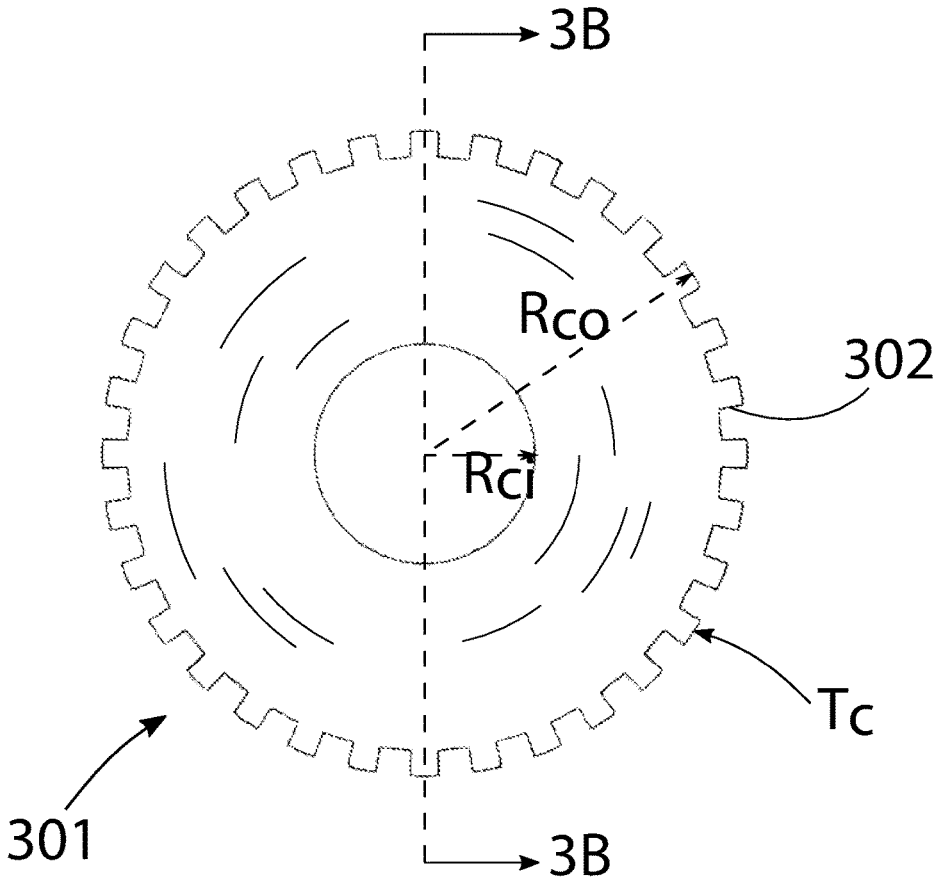
FIG. 3A shows a top view of the valve's annular core.
Figure 3B:
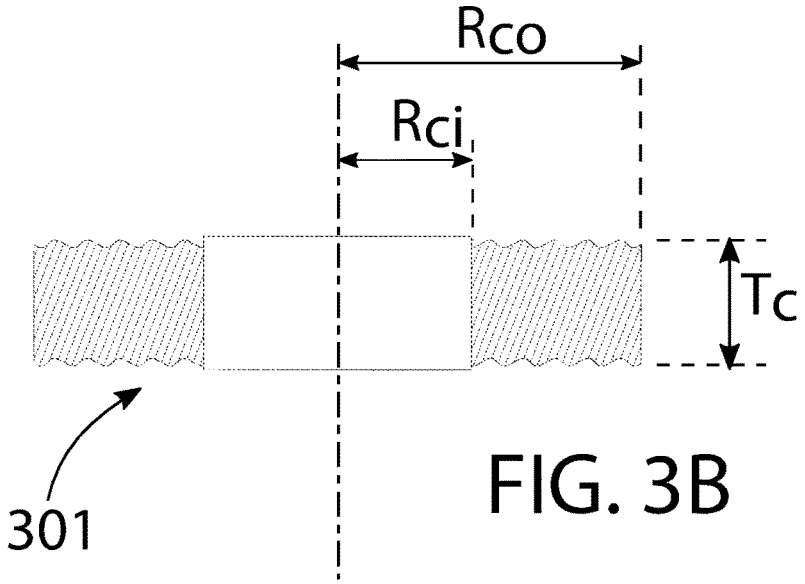
FIG. 3B presents a section view of the annular core shown in FIG. 3A.

FIG. 3A shows a top view of the valve's annular core 301, with inner radius $R_{ci}$, outer radius $R_{co}$, and thickness $T_c$. When the valve is assembled, the axial spacing between the inner surfaces of the shell's planar end walls is equal to the thickness of the annular core, $T_c$. FIG. 3A also shows core gear teeth 302 which, in this particular embodiment of the invention, are located at the outer perimeter of annular core 301. The core gear teeth provide a means for applying torque to the annular core in order to force its rotation about the valve axis. Other implementations are possible, such as locating the gear teeth nearer to the inner radius of the core, rather than at the periphery as shown in FIG. 3A. Some implementations of the gear teeth would require that the core housing's planar end walls modified in order to enclose those portions of the core driveshaft that extended beyond the upper or lower planar surfaces of the annular core. FIG. 3B shows a diametral section view of the annular core of FIG. 3A. The section view of 3B shows the inner and outer radii of the annular core, $R_{ci}$ and $R_{co}$ respectively. FIG. 3B also shows the thickness of the annular core, $T_c$, and the circular corrugations covering the planar surfaces of the annular core.

Figure 4:
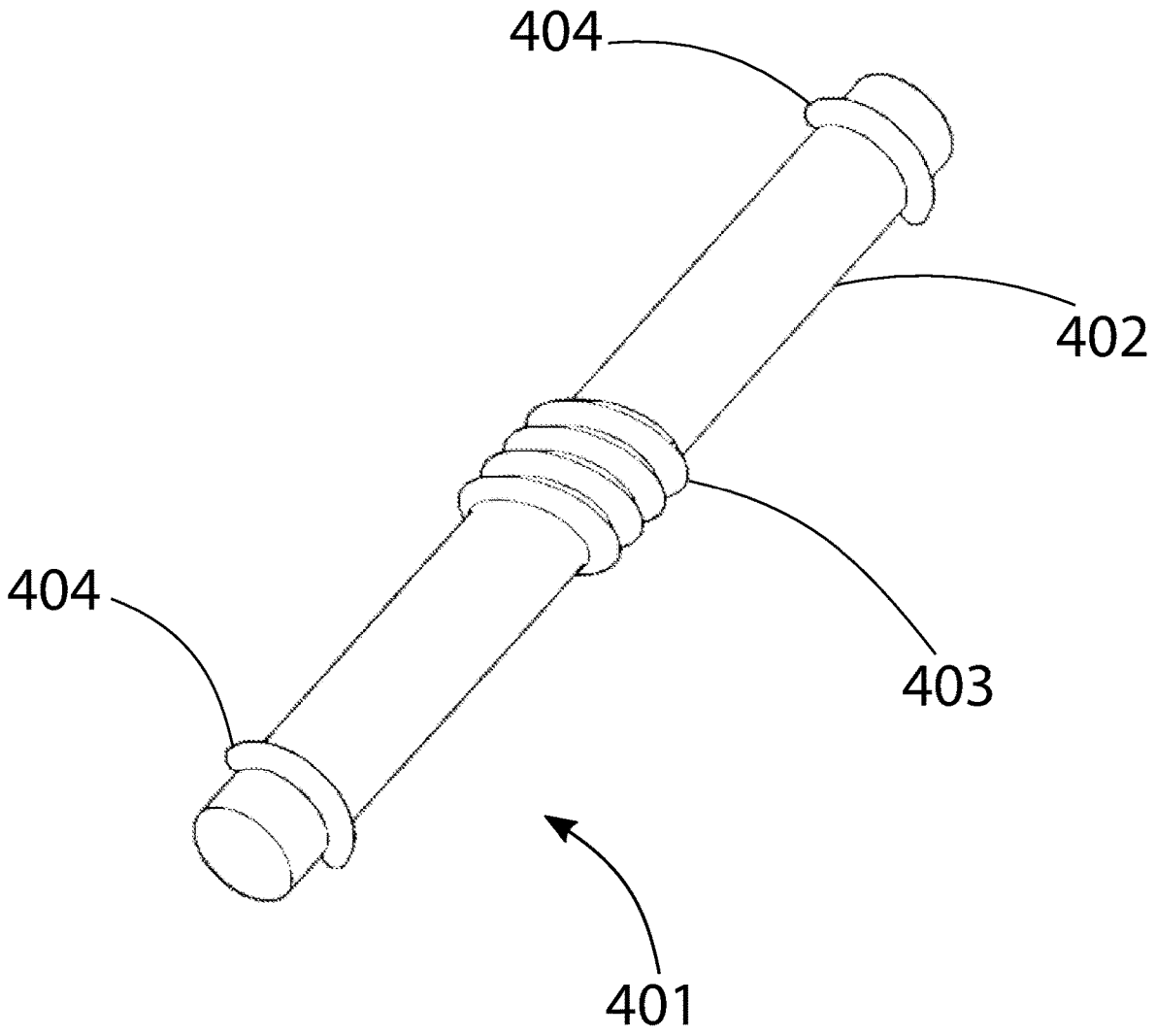
FIG. 4 shows the valve's core driveshaft.

FIG. 4 shows core driveshaft 401 which is comprised of central axle 402, core drive gear 403, and circumferential collars 404. The position of core driveshaft 401 within the shell's internal cavity is determined by the location of core driveshaft guide holes 211 which enclose central axle 402 at axial locations near its ends when the valve is assembled. The axial position of central axle 402 within core driveshaft guide holes 211 can be adjusted slightly to ensure that core drive gear 403 properly meshes with core gear teeth 302. When the valve is assembled, circumferential collars 404 can be adjusted to restrain core driveshaft 401 from axial motion. This ensures that core drive gear 403 is always axially positioned so as to properly mesh with core gear teeth 302. The meshed gear teeth allow the torque applied to core driveshaft 401 to be transferred to annular core 301, thereby forcing its rotation about the valve axis. Core drive gear 403 could be in the form of a multi-start worm gear or a helical gear, in which case the axis of core driveshaft 401 would not intersect the valve axis; or they could be in the form of a bevel gear, in which case the axis of core driveshaft 401 would perpendicularly intersect the valve axis.

The design of the presently revealed valve enables the rotation of the annular core to be directly synchronized with the rotation of the engine's crankshaft by means of simple mechanical linkages. This synchronization ensures that injection of fuel and oxidant gases into the valve's associated cylinder, and removal of exhaust gases from the valve's associated cylinder, are precisely coordinated with the reciprocating motion of the piston in the associated cylinder. The mechanical linkages between the crankshaft and the gear teeth on the valve's annular core eliminate the need for a camshaft, which is one of the most expensive and wear-susceptible components of a piston engine.

From this discussion it is clear that, for proper operation of the two-stroke engine referenced above, the valve's core must rotate at exactly the same rate as the engine's crankshaft, and its azimuthal orientation relative to the valve's shell must be accurately correlated with the position of the piston in the associated cylinder. If the valve were used in a four-stroke engine, the annular core would rotate at half the rate of the crankshaft.

Also, it is noted that, when the presently revealed valve is used in a piston engine, the rotational axis of the annular core is perpendicular to the rotational axis of the engine's crankshaft. An axis reorientation of 90 degrees is therefore required of the mechanical linkages which transfer torque from the crankshaft to the annular core. All three of the gear types mentioned above can provide this 90-degree axis reorientation, and they can do so regardless of the radial location of the core gear teeth 302.

Figure 5:
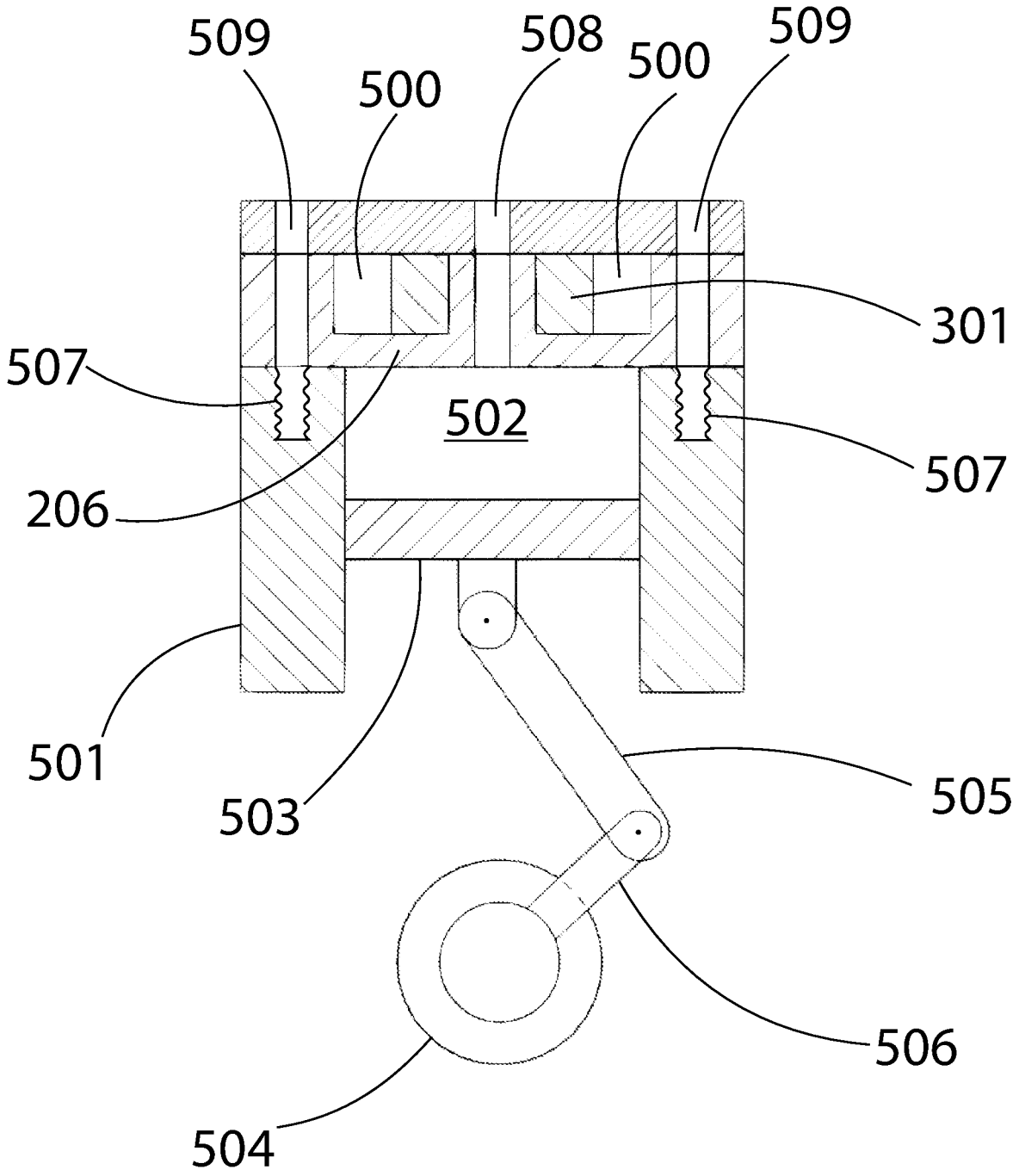
FIG. 5 shows a cross-sectional view of the valve installed on the engine block of a piston engine.

FIG. 5 shows a cross sectional view of the assembled valve mounted on engine block 501, with shell's lower end wall 206 serving as the stationary end of cylinder 502. Annular core 301 is shown within the shell's internal cavity 500. Piston 503 is linked to crankshaft 504 by connecting rod 505, which is attached to crank arm 506 extending from crankshaft 504. Through mounting holes 509 are shown in alignment with threaded mounting holes 507 in engine block 501. Electrical feedthrough hole 508 is shown centered on the axis of cylinder 502. Not shown in FIG. 5 are the valve's flow passages or the linkages that synchronize timing between the rotation of the crankshaft and the rotation of annular core 301. Also, FIG. 5 does not show the core gear teeth or the gear linkage between the core driveshaft and the core.

Assuming that the valve's shell is fabricated in two separate pieces as described above and as shown in FIG. 5, assembly of the valve involves (1) placing annular core 301 inside core housing 205 so the annular core's inner curved surface becomes closely engaged with the outer curved surface of annular hub 208 and the corrugations on the annular core's lower planar surface become closely engaged with the circular corrugations on the shell's lower end wall 206, (2) placing core driveshaft 401 inside core housing 205 so that central axle 402 extends through core driveshaft guide holes 211 and core drive gear 403 meshes with core gear teeth 302 in a manner which ensures that the azimuthal orientation of annular core 301 is properly synchronized with the reciprocating motion of piston 503, (3) placing a seal gasket on the top of housing side wall 207, and (4) placing housing cover 201 on the side wall gasket with cover mounting holes 203 aligned to housing mounting holes 210 and with cover feedthrough hole 202 aligned to hub feedthrough hole 209. Axially aligned mounting holes 203 and 210 create through mounting holes 509 which extend all the way through the valve's shell. Axially aligned feedthrough holes 202 and 209 create the electrical feedthrough hole 508 which also extends all the way through the valve's shell. It is noted that proper meshing of core drive gear 403 and core gear teeth 302 occurs when the radius of the pitch circle of core gear teeth 302 (referred to herein as the core moment arm length) is equal to the difference between the distance of the core driveshaft axis from the valve axis and the radius of the pitch circle of core drive gear 403.

Installation of the assembled valve on the engine block involves (1) placing a seal gasket on the engine block, (2) positioning the assembled valve on the block gasket so that through mounting holes 509 overlay the threaded mounting holes in the engine block, and (3) inserting threaded bolts into through mounting holes 509 and tightening them into the corresponding threaded mounting holes in the engine block until the upper and lower seal gaskets are appropriately compressed. When the valve is installed on the engine block, the planar surfaces of the valve's core are closely engaged with inner surfaces of the valve's planar end walls and the central axis of the associated cylinder coincides with the valve axis.

The valve's shell and its core both have multiple through penetrations, with the penetrations all having the shape of annulus sectors whose axes coincide with the valve axis when the valve is assembled. The shape, the size, the relative location, and the relative motion of these penetrations are essential features of the present invention.

The penetrations in the shell pass through its planar end walls. These end-wall penetrations exist as geometrically congruent penetration pairs whose central axes coincide with the valve axis. One of the penetrations in each congruent penetration pair is in the shell's lower end wall and one is in the shell's upper end wall. In the valve coordinate system, the two penetrations constituting a congruent penetration pair have the same radial location and the same azimuthal location. This means that the two penetrations constituting a congruent penetration pair occupy positions in the shell's planar end walls that are directly opposite each other. The penetrations constituting a congruent penetration pair are sometimes referred to herein as the "elements" of the congruent penetration pair. It is noted that the design of the presently revealed valve is such that is each congruent penetration pairs has a different radial location.

As is the case with the shell, the core penetrations also have the shape of annulus sectors, with there being one core penetration for each congruent pair of shell penetrations. Each core penetration has the same radial location as one, and only one, congruent penetration pair. This means that, for some predetermined time interval during each complete rotation of the core—a time interval determined by the total azimuthal extent of the corresponding shell and core penetrations—each core penetration overlaps and is volumetrically linked to the elements of one specific congruent penetration pair, thereby forming a flow passage that extends completely though the valve. The core penetration and the two penetrations constituting the corresponding congruent penetration pair are referred to herein as a "penetration triplet." The volumetric linking of the penetrations constituting a penetration triplet form a high conductance flow passage.

Figure 6:
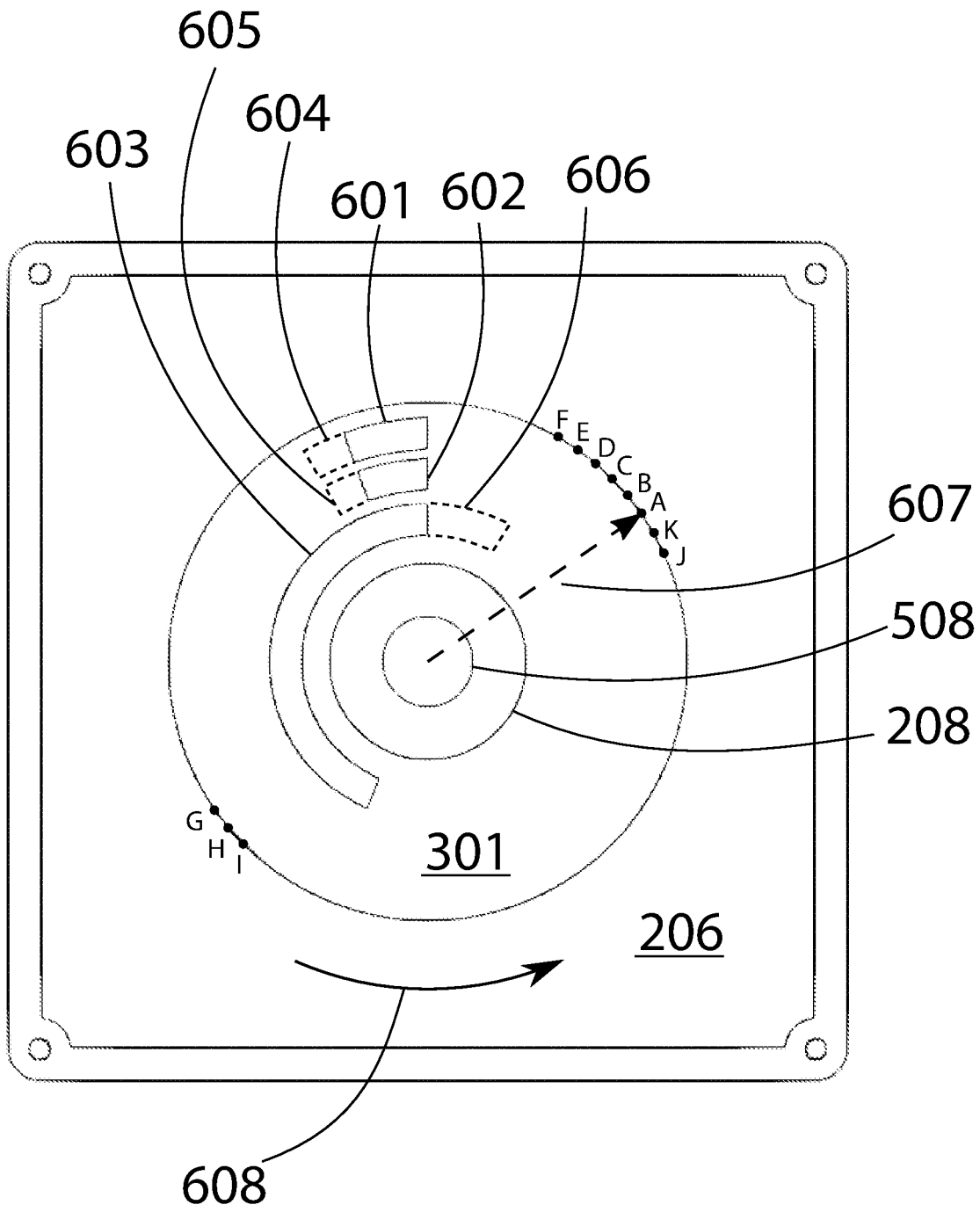
FIG. 6 shows penetrations in the valve's annular core, with the penetrations having the shape of annulus sectors. The core penetrations are shown in their azimuthal relationship to the shell penetrations.

FIG. 6 shows a top view of annular core 301 as it is positioned at valve assembly, that is, annular core 301 is shown surrounding annular hub 208 and electrical feed-through hole 508, and overlaying the closely engaged portion of lower end wall 206. FIG. 6 also shows core fuel transfer penetration 601, which has inner radius $R_{fi}$, outer radius $R_{fo}$, and azimuthal extent $\Delta\theta_{fc}$, core oxidant transfer penetration 602, which has inner radius $R_{oi}$, outer radius $R_{oo}$, and azimuthal extent $\Delta\theta_{oc}$; and core exhaust transfer penetration 603, which has inner radius $R_{ei}$, outer radius $R_{eo}$, and azimuthal extent $\Delta\theta_{ec}$.

The penetrations in the core housing's lower end wall 206 are not directly visible in FIG. 6 because they are beneath annular core 301. Therefore, in FIG. 6, the outline of the penetrations in the housing's lower end wall are shown as dashed lines. Each of these penetrations—the housing's fuel, oxidant, and exhaust penetrations—has the same inner radius and the same outer radius as the corresponding core penetration. However, the azimuthal extent of the corresponding penetrations is not the same. The housing's fuel transfer penetration 604 has an azimuthal extent $\Delta\theta_{fh}$, the housing's oxidant transfer penetration 605 has azimuthal extent $\Delta\theta_{oh}$, and the housing's exhaust transfer penetration 606 has azimuthal extent $\Delta\theta_{eh}$. FIG. 6 also shows core reference marker 607 for tracking the core's rotation. The direction of the core's rotation is shown by solid curved arrow 608. The figure illustrates penetration locations and sizes that would be typical for the preferred embodiment of the valve when it is used in an external-compression two-stroke engine. No gear teeth are shown on annular core 301 in order to avoid confusion with the angle reference marks.

It is to be understood that, for any embodiment of the presently revealed valve, the radial locations of the individual congruent penetration pairs are different, as defined above. Each congruent penetration pair has its own unique radial location. The individual congruent penetration pairs may have different radial extent, depending on the conductance required of the flow passages comprising the congruent penetration pairs. Also, the azimuthal extent of the individual congruent penetration pairs may be different, depending on the duration of the closed-open-closed time intervals required of the flow passages comprising the congruent penetration pairs.

The valve's design is such that the azimuthal extent of elements of any congruent penetration pair is less than or equal to the azimuthal extent of the corresponding core penetration. Since the radial dimensions of the corresponding penetrations are the same, the difference in azimuthal extent means that the cross-sectional area of the shell penetrations constituting a congruent penetration pair is always less than or equal to the cross sectional area of the corresponding core penetration. When any specific flow passage is open or partially open, its conductance is determined primarily by the penetration(s) having of the smallest cross-sectional area of the penetration triplet comprising the flow passage, and that is always the cross-sectional area of the elements of the shell's congruent penetration pairs. The cross-sectional areas of the individual elements constituting the fuel, oxidant, and exhaust congruent penetration pairs are given by $$A_f = \frac{\Delta\Theta_{fh}(R_{fo}^2 - R_{fi}^2)}{2}$$

$$A_o = \frac{\Delta\Theta_{oh}(R_{oo}^2 - R_{oi}^2)}{2}$$

$$A_e = \frac{\Delta\Theta_{eh}(R_{eo}^2 - R_{ei}^2)}{2}$$

where the various $\Delta\theta$'s are expressed in radians. These cross sectional areas give a measure of the maximum relative conductance achievable for the fuel, oxidant, and exhaust flow passages that are formed by the volumetric linking of the penetration triplets.

It is seen that the conductance of each flow passage depends on two factors: (1) $\Delta\theta_{xh}$, the azimuthal extent of the elements of the flow passage's congruent penetration pair, and (2) $[(R_o)^2-(R_i)^2]$, the difference in the squares of the lengths of the outer and inner radii of the elements of flow passage's congruent penetration pair. (The subscript "x" is intended to refer to either the fuel, oxidant, or exhaust flow passages.) However, the azimuthal extent of the elements of a congruent penetration pairs, $\Delta\theta_{xh}$, also determines, in part, the duration of the time interval for which the flow passage remains open or partially open. So the design parameter that is used to control the conductance of the flow passages is the difference in the squares of the inner and outer radii of the elements of the flow passage's congruent penetration pair. An important advantage of the presently revealed valve is that the valve designer has independent control over the conductance of flow passages and durations of the time intervals for which the flow passages are open or partially open.

In applications involving two-stroke engines, the azimuthal velocity of the valve's core is equal to the azimuthal velocity of the of the engine's crankshaft. In terms of crankshaft azimuthal angle, the transition periods of the fuel, oxidant, and exhaust flow passages occur during rotation angles of $\Delta\theta_{fh}$, $\Delta\theta_{oh}$, and $\Delta\theta_{eh}$, respectively. The time periods during which the fuel, oxidant, and exhaust flow passages are fully open are $(\Delta\theta_{fc}-\Delta\theta_{fh})$, $(\Delta\theta_{oc}-\Delta\theta_{oh})$ and $(\Delta\theta_{ec}-\Delta\theta_{eh})$, respectively. The total closed-open-closed transition periods for the fuel, oxidant, and exhaust flow passages are $(\Delta\theta_{fc}+\Delta\theta_{fh})$, $(\Delta\theta_{oc}+\Delta\theta_{oh})$, and $(\Delta\theta_{ec}+\Delta\theta_{eh})$, respectively.

For external-compression two-stroke engines, the flow passages that transfer fuel and oxidant gases to the engine's cylinders must begin to open precisely when the piston in the associated cylinder reaches its top-dead-center position. FIG. 6 shows the azimuthal position of the core when the piston is at top-dead center. At piston top-dead-center, the housing and core fuel transfer penetrations are immediately adjacent to each other and the housing and core oxidant transfer penetrations are immediately adjacent to each other. As seen in the figure, these conditions occur when core reference marker 607 is at position A. As the annular core rotates past position A, the corresponding housing and core penetrations begin to overlap and the conductance of the fuel and oxidant flow passages begins to increase. When annular core reference marker 607 is at position B, the fuel and oxidant flow passages are about half open and at position C, they are fully open. At position D the fuel and oxidant flow passages begin to close, at position E they are back to half open and then at position F they are completely closed. As was mentioned earlier, in the preferred embodiment of the valve, it is required that the fuel and oxidant gases must enter the cylinder within 8 or 10 degrees of piston top-dead-center. This means that the azimuthal extent of the housing and core penetrations comprising the fuel and oxidant flow passages must be less than four or five degrees. The presently revealed valve can easily accomplish these demanding requirements because very accurate mechanical tolerances are achievable in the process of machining the penetrations.

Not only can the radial and azimuthal dimensions of the various penetrations be very accurately machined, but the radial dimensions of the penetrations can be machined independently of the azimuthal dimensions so as to provide the conductance required of the flow passages without affecting the relative timing of their opening and closing. The ability to independently control conductance and open/closed time intervals is an important feature of the presently revealed valve that is not available from previously revealed valves. It is noted that the quantity of fuel or oxidant gases moving through a flow passage can be controlled by varying pressures of the fuel or oxidant gases at the input ports of the relevant flow passage.

Figure 7A:
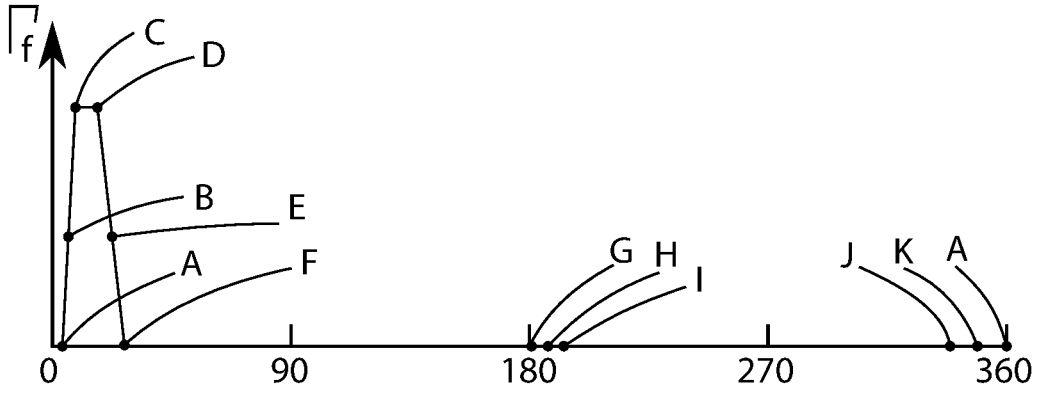
FIGS. 7A, 7B, and 7C show graphs of flow passage conductance versus crankshaft rotation angle for the valve's fuel inlet flow passage, its oxidant inlet flow passage, and its exhaust flow passage, respectively.
Figure 7B:
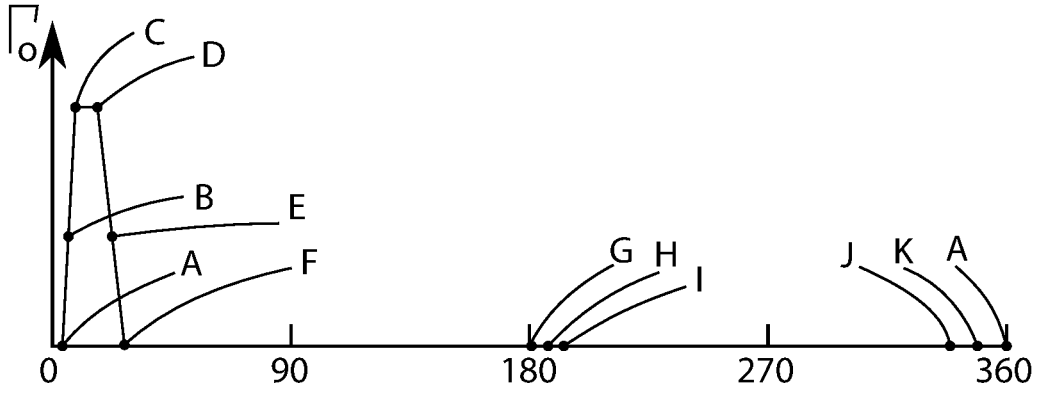
Figure 7C:
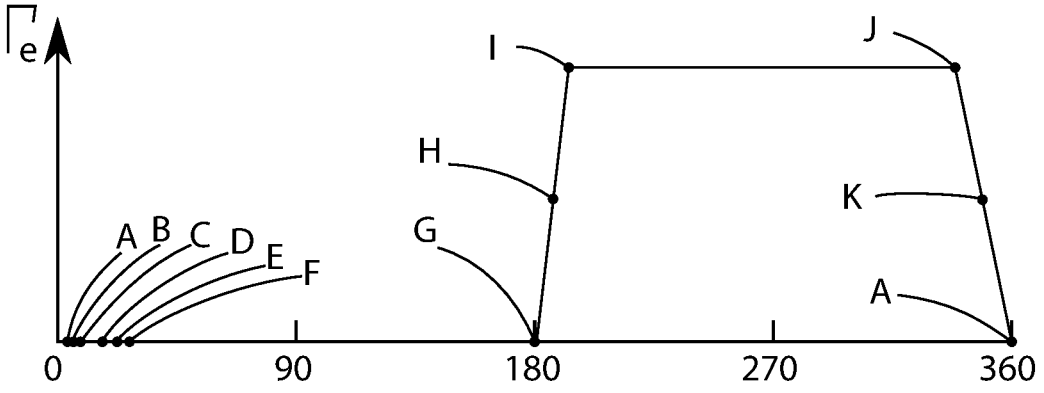

FIG. 6 shows adjacent fuel and oxidant shell penetrations. This is done in order to promote mixing of the pressurized gas stream entering the cylinders. It is anticipated that, in larger engines, multiple pairs of fuel and oxidant flow passages located at different points across the stationary end of the associated cylinder would be used to provide even better fuel/oxidant mixing. Regarding the exhaust flow passage, it is shown in FIG. 6 that the angular separation of the core and shell exhaust penetrations is 180 degrees when annular core reference marker 607 is at position A, which corresponds to piston top-dead-center. This means that the exhaust flow passage will begin to open at piston bottom-dead-center, which is 180 degrees after the fuel and oxidant flow passages begin to open. This occurs when annular core reference marker 607 has rotated to position G. As the annular core continues to rotate, position H marks the point at which the exhaust flow passage is half open; at position I, the flow passage is full open; at position J, the flow passage begins to close; at position K, the valve is half closed; and when the valve returns to position at position A, which corresponds to piston top-dead center, the exhaust flow passage is completely closed. Plots of relative conductance $\Gamma_f$, $\Gamma_o$, and $\Gamma_e$ for the fuel, oxidant, and exhaust flow passages are shown in FIGS. 7A, 7B, and 7C respectively, with annular core rotation markers A through K in the figures corresponding to the annular core rotational positions explained above. There is a one-to-one correspondence between core rotation angles marked along the horizontal axis of the figure and crankshaft rotation angles.

From the above discussion, it is seen that the locations of the annular core penetrations do not affect the locations of the flow passage ports in the stationary end of the cylinder. Those locations are determined solely by the locations of the shell's congruent penetration pairs, and the locations of the congruent penetration pairs may be selected independently of other considerations to achieve design goals such as enhancing gas mixing in the cylinder or eliminating hot spots on the valve's lower end wall.

An important feature of the presently revealed valve is that it can be fabricated with as many penetration triplets as desired, with each penetration triplet representing a flow passage within the valve. The number of penetration triplets within the valve does not affect the overall mechanical profile of the valve. This feature offers many important capabilities. As an example, one of a valve's flow passages could be connected to a reservoir containing pressurized air and another could be connected to a reservoir containing pressurized oxygen. The relative azimuthal coordinates of the penetration triplets comprising these flow passages could be chosen so that air and oxygen would be injected into the cylinder simultaneously, with the injected quantities of these oxidants being controlled by regulating their pressures at the upper (input) ports of the two flow passages. This capability is important in applications where it is desirable to control flame speed during the combustion process. Similarly, for some engine applications it is desirable to use precisely controlled mixtures of different fuels. The valve could be designed with multiple fuel transfer flow passages and each flow passage could be connected to a different fuel reservoir. This enables the simultaneous injection of different fuels in desired ratios, again by regulating the fuel pressures at the upper ports of the flow passages. This is particularly important for non-carbon fuels derived from renewable resources, fuels such as ammonia and hydrogen, which must be mixed in specific ratios—preferably immediately prior to initiating the combustion process within the associated cylinder—in order to produce best engine efficiency. In general, specific fuel and oxidant mixes are important in achieving best engine efficiencies. The presently revealed valve easily accommodates this need. Also, the valve makes it possible to inject oxidants and fuel species at multiple locations across the closed end of the cylinder, a technique which is important in achieving better fuel and oxidant mixing prior to ignition and more complete combustion in large diameter cylinders. Finally, it is noted that the valve's design makes it possible to remove exhaust from multiple locations across the stationary end of the cylinder, which is a technique that can reduce the localized thermal loading caused by the hot exhaust gases as they exit the cylinder.

Figure 8:
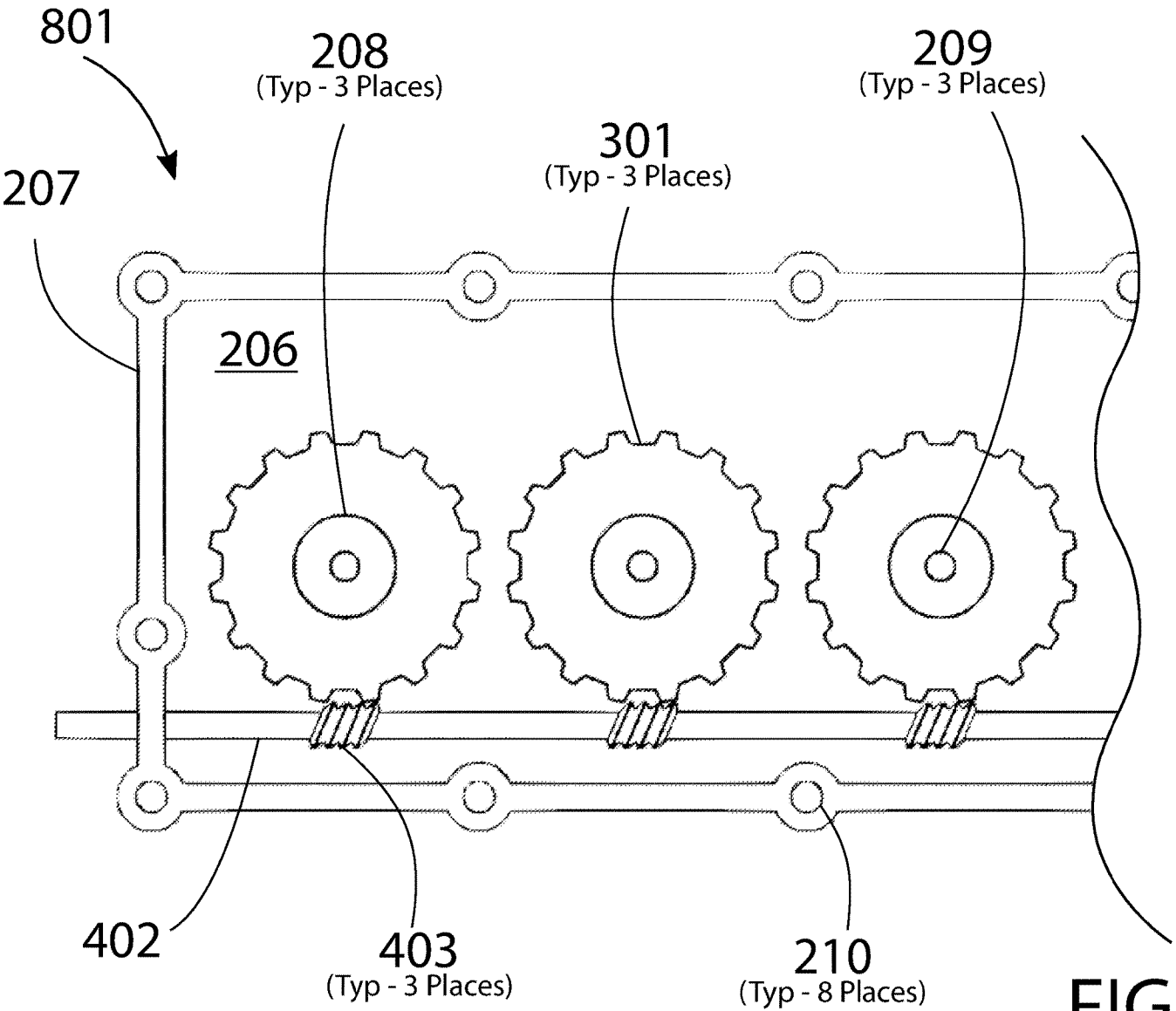
FIG. 8 show a top view of a portion of a partially assembled valve assembly which could be deployed on a multi-cylinder engine.

In previous paragraphs, the presently revealed valve has been discussed in terms of its deployment with a single associated cylinder. In multi-cylinder engines, multiple valves are mechanically linked together to form a valve assembly. All of the valves comprising the valve assembly are contained within a single internal cavity. FIG. 8 shows a top view of a portion of a partially assembled valve assembly 801. Valve assembly 801 has a set of through mounting holes 210 that correspond to a set of threaded mounting holes in the engine block of the multi-cylinder engine. Valve assembly 801 includes one annular hub 208 for each of the engine's cylinders, and the central axis of each annular hub 208 coincides with the axis of an associated cylinder when valve assembly 801 is mounted to the associated engine block. Each annular hub 208 encloses a hub feedthrough hole 209 which has characteristics and functions as described above. When the valves are assembled within valve assembly 801, each annular hub 208 is surrounded by an annular core 301 and all of the annular cores 301 are driven by core drive gears 403 which are affixed to core axle 402 at axial locations which cause individual core drive gears 403 to mesh with the core gear teeth of annular cores 301. It is noted that, for any of the valve assembly's valves, the pattern of end-wall penetrations is the same at each valve location and the pattern of core penetrations is the same for each annular core. The only operational difference in the individual valves is the way in which the core gear teeth are interfaced with core drive gears 403. This interface provides for a different absolute azimuthal orientation for each annular core 301. This is necessary to account for the firing order of the individual cylinders.

For the entire valve assembly, penetrations in the shell's planar end walls and the in annular cores are as described above for a single valve. The valve assembly is best deployed on the flat surface of an engine block. For "V type" engines, two valve assemblies would be used, with one valve assembly mounted for each bank of cylinders on the two flat surfaces of the engine block. In some engine designs, the internal cavity of the valve assembly (or valve assemblies) could be volumetrically linked to the engines crankcase, thereby eliminating the need for core driveshaft guide holes. The lateral and axial positions of the core driveshaft must still be stabilized and this is done by means of multiple core driveshaft supports located within the internal cavity. The core driveshaft supports would not need to be gas tight because they would be within the valve assembly's internal cavity.

In summary, the novel features of the presently revealed valve offer several advantages over valves currently used in piston engines. For some engines, such as external-compression two-stroke engines, the presently revealed valve provides essential enabling technology. The following paragraphs discuss important features of the valve and contrast the resulting operational advantages to related features of valves used in contemporary piston engines.

First, the presently revealed valve's flow passages are opened and closed by the rotation a single, lightweight annular core. The torque required to force rotation is relatively small because of the core's small mass. Also, the required torque is invariant with regard to the angular velocity of the crankshaft (engine rpm) and it is constant over the course of each rotation of the crankshaft. By way of contrast, consider the camshaft-driven poppet valves used in most contemporary piston engines. Because the camshaft relies on the eccentricity of its cam lobes to force the movement of the valve stems, the torque required to operate poppet valves changes considerably during each crankshaft rotation. These sudden changes in applied torque result in relatively rapid wear of the cam lobes and of the mechanical linkages between the crankshaft and the poppet valve stems. Both of these issues adversely affect engine timing and engine performance. The constant torque required by the core of the presently revealed valve minimizes wear on valve components and on the associated mechanical linkages.

Second, the sealing surfaces of the presently revealed valve are shielded from hot combustion products by the valve's lower end wall, and because they are shielded, the surfaces can be continuously lubricated, thereby greatly reducing the wear induced by friction between rotating and non-rotating elements of the valve. Also, since the valve's lower end wall is stationary, it can be actively cooled if desired, thereby providing additional thermal protection for the sealing surfaces. The valve seats of poppet type valves are directly exposed to hot combustion products. This can cause overheating of the exposed surfaces which can result in corrosion of the sealing surfaces and valve leakage.

Third, when the presently revealed valve is installed on an engine block, the lower end wall of the valve serves as the stationary end of the associated cylinder. Thermal energy transferred to the valve's lower end wall is spread over a relatively large area, causing a more uniform temperature distribution across the associated cylinder's stationary end wall. The temperatures are made even more uniform by the rotation of the annular core which moves thermal energy from higher to lower temperature locations across the area of the cylinder's stationary end wall. With poppet valves, the valve heads can become extremely hot because they are not directly cooled and they are not in good thermal contact with cooled heat sinks. The poppet valve heads can become so hot that they cause pre-ignition of fuel/oxidant gas mixes (engine knocking), thereby reducing engine power and ultimately leading to engine failure.

Fourth, the flow passages of the presently revealed valve terminate at the interface between the valves lower end wall and the internal volume of the associated cylinder. There is never any mechanical interference between the valve ports and the piston in the associated cylinder. This means that, with the presently revealed valve, the clearance volume of the associated cylinder can be as small as reasonable mechanical tolerances will allow, a fact which is used to greatly increase the efficiency of external-compression two-stroke engines of the type revealed in U.S. Pat. No. 10,352,233. Poppet valves, on the other hand, are reentrant with respect to the internal volume of the associated cylinder, and the clearance volume is always greater than in an engine whose valves have no interference.

Fifth, in the presently revealed valve, the flow passages open and close as a result of core movement across the flow passages. The opening and closing of a flow passage is therefore independent of pressure differences along the flow passage axis. The opening and closing of a poppet valve involves movement of the valve head along the axis of the associated flow passage, meaning that pressure differences along the axis affect the valve's ability to open and close. Poppet valves operate best when their normal motion is enhanced by pressure differences along the axis of the valve stem. This means that valve timing changes at very low and very high engine speeds, thereby limiting the operational range over which engine performance is optimal. The presently revealed valve has the same operational capabilities at low and high engine speeds. With the presently revealed valve, there is no preferred band of engine speeds.

Sixth, the penetrations comprising the flow passages of the presently revealed valve are in the form of annulus sectors, with the radial locations of the sectors being such that, once during each complete core rotation, each core penetration overlaps and becomes volumetrically linked to one of the shell's congruent penetration pairs. The core's angular velocity is unchanged as the penetrations move in and out of alignment. The cross-sectional shape of these penetrations provides the most rapid onset and conclusion of closed-open and open-closed transitions that are geometrically possible. No other cross-sectional geometry performs as well in terms of speed and projected azimuthal angle extent. These rapid transitions represent essential enabling technology for external-compression two-stroke engines. These engines require that fuel and oxidant gases be injected into the cylinders during only a few degrees of crankshaft rotation. A poppet valve, whether camshaft driven, pneumatically driven, or electrically driven, is incapable of such rapid response. When a poppet valve is activated, its head starts from rest and moves parallel to its flow passage axis as it accelerates. As the valve head accelerates, it continues to partially block its associated flow passage until it enters the internal volume of the cylinder. This means that the conductance of the flow passage is relatively low until the valve head clears the end of the flow passage and begins to decelerate inside the cylinder's internal volume. After the valve head comes to a stop, it again accelerates and then decelerates as it returns to its closed position, again partially blocking the flow passage over most of its return path. Also, the presently revealed valve provides very precise relative and absolute control of the time intervals for which the valves flow passages are open. For camshaft-driven poppet valves, the precision is limited by the ramp slopes of the cam lobes. Even for electrically or pneumatically driven poppet valves, the acceleration-deceleration requirements place severe demands on the energy sources driving the valve heads, and this affects the transition times that can be achieved.

Seventh, the valve's flow passages are formed in a predetermined temporal sequence by the volumetric linking of shell and core penetrations. The relative time of opening and closing of the flow passages, as well as the duration of the time intervals for which the flow passages remain open, is determined by the azimuthal locations of the penetrations and by the azimuthal extent of the penetrations, respectively. The locations and dimensions of the penetrations are precisely and fixedly determined when the shell and the core are fabricated. These locations and dimensions do not change with engine operating conditions nor do they change because of mechanical wear over the lifetime of the engine. The required engine timing (opening and closing of various flow passages) are essentially built into the valve when it is manufactured and it does not change over time. Because of the valve's rapid transition times, the need for temporal overlap of closed-open-closed time intervals is eliminated. Also, the valve performance is invariant with regard to engine rpm, whereas spring loaded poppet valves are subject to "valve float" at high rpm. Poppet valves have a relatively slow closed-open-closed transition times, which means that engine performance is often compromised by the need to have a temporal overlap of the different open to closed and closed to open time intervals.

Eighth, the quantity of gas moved through the fuel and oxidant flow passages of the presently revealed valve is regulated by controlling the fuel and oxidant gas pressures at the input ports of the respective flow passages. The pressures are controlled by pressure regulating valves at the inputs to small auxiliary reservoirs that are connected to the input ports of the fuel and oxidant flow passages. The pressure in these reservoirs can easily be varied over times required for the engine to execute a few tens of engine cycles (a few hundred milliseconds or less), so with the presently revealed valve, engine power levels can be changed on time scales less than the time scales for changing power in a conventional engine. Again, the ability to independently regulate the quantity of fuel and oxidant suppled to a cylinder without affecting engine timing is another example of the utility and flexibility of the presently revealed valve.

What is claimed is:

1. A multi-port rotary valve which provides flow control of fuel, oxidant, and exhaust gases for a cylinder in the engine block of a piston engine, with said valve having through mounting holes set in a pattern that matches a pattern of threaded mounting holes in said engine block, thereby allowing said valve to be mounted directly to said engine block by means of threaded bolts, and with said valve comprised of a) a shell which is fixed in location and orientation with respect to surrounding structure, with said shell having the form of a rigid mechanical fixture which encloses an internal cavity, and with said shell having i) an annular hub, with the outer curved surface of said annular hub defining the inner radial boundary of said internal cavity when said valve is assembled, and with the axial extent of said annular hub being equal to the axial extent of said internal cavity when said valve is assembled, and with the inner curved surface of said annular hub defining the radial boundary of an electrical feedthrough hole when said valve is assembled, and with said electrical feedthrough hole having tapered threads over the portion of its length that is adjacent to said engine block when said valve is mounted to said engine block, and with said tapered threads enabling the installation of a correspondingly threaded high-voltage electrical feedthrough in said electrical feedthrough hole, and with the electrodes of said high-voltage electrical feedthrough being volumetrically linked to the internal volume of said cylinder when said high-voltage electrical feedthrough is installed in said electrical feedthrough hole and said valve is mounted to said engine block, and with the central axis of said annular hub, referred to herein as the valve axis, coinciding with the extended central axis of said cylinder when said valve is mounted to said engine block, and ii) two substantially planar end walls, with said planar end walls being parallel to each other and perpendicular to said valve axis when said valve is assembled, and with said planar end walls each having a hole which overlays said electrical feedthrough hole when said valve is assembled, and with said planar end walls being separated by a distance, as measured between their opposed surfaces, which is equal to the axial extent of said internal cavity when said valve is assembled, and with the opposed surfaces of said planar end walls each having an array of circular corrugations that are centered on said valve axis when said valve is assembled, and with each of said arrays of circular corrugations covering an annular region whose inner curved boundary coincides with the outer curved boundary of said annular hub when said valve is assembled, and with one of said planar end walls being referred to herein as the lower end wall when said valve is assembled and with one of said planar end walls being referred to herein as the upper end wall when said valve is assembled, and with said lower end wall being closely engaged with the surface of said engine block when said valve is mounted to said engine block, and with said lower end wall thereby enabling creation of a gas-tight gasket seal between said lower end wall and said engine block when said valve is mounted to said engine block, and with said lower end wall thereby functioning as the stationary end of said cylinder when said valve is mounted to said engine block, and with said lower end wall and said upper end wall each having (1) multiple end-wall penetrations, with each of said end-wall penetrations having the shape and orientation of an annulus sector whose central axis coincides with said valve axis when said valve is assembled, and with each of said end-wall penetrations being geometrically congruent with one other end-wall penetration, thereby forming a congruent penetration pair, and with one element of each of said congruent penetration pairs being in said lower end wall when said valve is assembled, and with one element of each of said congruent penetration pairs being in said upper end wall when said valve is assembled, and with the two elements of each of said congruent penetration pairs occupying the same radial location and the same azimuthal location relative to said valve axis when said valve is assembled, and with each of said congruent penetration pairs having a radial location which is different from the radial locations of all other congruent penetration pairs when said valve is assembled, and iii) a side wall which surrounds and radially encloses said internal cavity when said valve is assembled, with said side wall having two core driveshaft guide holes which are coaxial, and with said core driveshaft guides hole having the same diameter, and b) a rotatable annular core which is positioned within said internal cavity when said valve is assembled, with the inner curved surface of said annular core being closely engaged with the outer curved surface of said annular hub when said valve is assembled, thereby causing the central axis of said annular core to coincide with said valve axis, and with each of the planar surfaces of said annular core being covered by a pattern of circular corrugations that are centered on said valve axis when said valve is assembled, and with said annular core's corrugated surfaces being closely engaged with said planar end walls' corrugated surfaces when said valve is assembled, and with the corrugation peaks of each corrugated surface occupying the corrugation valleys of the opposed closely engaged surface when said valve is assembled, and with all closely engaged surfaces being continuously suffused with a lubricating sealant which forms gas-tight seals between said closely engaged surfaces while said piston engine is operating, and with said lubricating sealant enabling said annular core to rotate freely about said annular hub while said piston engine is operating, and with said annular core having i) multiple core penetrations, with each of said core penetrations having the shape and orientation of an annulus sector whose central axis coincides with said valve axis when said valve is assembled, and with each of said core penetrations having the same radial location relative to said valve axis as one of said shell's congruent penetration pairs when said valve is assembled, thereby ensuring that each of said core penetrations overlaps and becomes volumetrically linked with one of said congruent penetration pairs during each complete rotation of said annular core, and with the relative azimuthal locations of said core penetrations and said congruent penetration pairs being such that the volumetric linking of said core penetrations with said congruent penetration pairs produces high conductance flow passages in a predetermined temporal sequence that is synchronized with the movement of the piston in said cylinder while said piston engine is operating, and with the azimuthal extent of said core penetrations and said congruent penetration pairs being such that said high conductance flow passages open and close at predetermined times that are synchronized with the movement of the piston in said cylinder while said piston engine is operating, and ii) a circular arrangement of core gear teeth, with said core gear teeth located at a predetermined radial distance from said valve axis when said valve is assembled, and with said predetermined radial distance referred to herein as the core moment arm length, and with said core moment arm length being such that said core gear teeth mesh with the teeth of a gear whose axis coincides with the axis of said core driveshaft guide holes when said valve is assembled, and c) a core driveshaft comprised of a central axle and a core drive gear which is affixed to said central axle, with said central axle extending through said core driveshaft guide holes when said valve is assembled, and with said central axle being positioned axially within said core driveshaft guide holes so that said core drive gear meshes with said core gear teeth when said valve is assembled, and with said central axle having movable circumferential collars affixed at axial locations that prevent axial movement of said core driveshaft while said piston engine is operating, and with the interfaces between said central axle and said core driveshaft guide holes being in the form of lubricated gas-tight seals which allow said central axle to rotate freely within said core driveshaft guide holes while said piston engine is operating.

2. A valve as described in claim 1 wherein said internal cavity is volumetrically linked to the crankcase of said engine block, with the position of said core driveshaft being maintained, both laterally and axially, by core driveshaft supports that are within said internal cavity, thereby eliminating the need for gas-tight core driveshaft guide holes.

3. A valve assembly comprised of a multiplicity of valves as described in claim 1, with the number of said valves in said valve assembly being equal to the number of cylinders in an associated multi-cylinder piston engine, and with all of said valves of said valve assembly being enclosed within a single internal cavity, and with each of said valves providing flow control of fuel, oxidant, and exhaust gases for one of said cylinders in said multi-cylinder piston engine while said multi-cylinder piston engine is operating.

4. A valve assembly as described in claim 3 wherein said internal cavity is volumetrically linked to the crankcase of said multi-cylinder piston engine, with the position of said core driveshaft being maintained, both laterally and axially, by core driveshaft supports that are within said internal cavity, thereby eliminating the need for gas-tight core driveshaft guide holes.

* * * * *